US006079049A

United States Patent [19]

Moir

[11] Patent Number: 6,079,049

[45] Date of Patent: Jun. 27, 2000

[54] COMBINATION PAIR OF GLOVES WITH HOUSING ACCESSORIES FOR REPLACEABLY ATTACHING TO A GARMENT

[76] Inventor: Melvin Moir, 2508 Broadway, Apt. 11G, New York, N.Y. 10025

[21] Appl. No.: 09/157,404

[22] Filed: Sep. 21, 1998

[51] Int. Cl.[7] ..... A41B 1/00

[52] U.S. Cl. ..... 2/69; 2/85; 2/93; 2/108; 2/80; 2/159

[58] Field of Search ..... 2/69, 69.5, 102, 2/108, 93, 94, 85, 158, 159, 16, 75, 80, 96, 48, 51, 160, 161.4, 162, 917, 910, 915

[56] References Cited

U.S. PATENT DOCUMENTS

| | | | |
|---|---|---|---|
| D. 311,271 | 10/1990 | Mann . | |
| 2,710,409 | 6/1955 | Burandt | 2/159 |
| 3,428,962 | 2/1969 | Simovitz | 2/159 |
| 4,055,873 | 11/1977 | Kallman | 2/94 |
| 4,168,544 | 9/1979 | Kallman | 2/94 |
| 4,261,059 | 4/1981 | Spitz | 2/108 |
| 4,351,067 | 9/1982 | Bartels | 2/159 X |
| 4,387,838 | 6/1983 | Jackson . | |
| 4,451,932 | 6/1984 | Wageman et al. | 2/80 |
| 4,587,673 | 5/1986 | Boliard | 2/159 |
| 4,761,835 | 8/1988 | Chen . | |
| 4,766,611 | 8/1988 | Kim . | |
| 4,862,521 | 9/1989 | Mann . | |
| 5,003,637 | 4/1991 | Lonon . | |
| 5,117,508 | 6/1992 | Gunter . | |
| 5,365,609 | 11/1994 | Herzog . | |

*Primary Examiner*—Gloria M. Hale
*Attorney, Agent, or Firm*—Richard L. Miller, P.E.

[57] ABSTRACT

A pair of gloves for replaceably attaching to a garment. The pair of gloves include a first glove for covering one hand of a user, a second glove for covering the other hand of the user, and accessories disposed on at least one of the first glove and the second glove. The first glove includes a strip of hook portion of hook and loop fasteners which selectively mates with either a strip of mating loop portions of the hook and loop fasteners positioned on the garment or directly with the garment itself when it is of a loop type material, and a strip of loop portions of hook and loop fasteners. The second glove includes a strip of hook portions of hook and loop fasteners which selectively mates with either the strip of loop portions of hook and loop fasteners of the first glove, another strip a mating loop portions of the hook and loop fasteners for positioning on the garment, or directly with the garment itself when it is of a loop type material. The accessories include a watch sewn into the second glove and which so orientated on the second glove that its is readable when the second glove is attached to the garment, by merely pivoting the second glove slightly upwardly towards the face of the user as the user looks down, and a zippered change pouch sewn into the first glove which allows the zippered change pouch to be hid from view both when worn and when attached to the garment.

8 Claims, 2 Drawing Sheets

FIG. 1
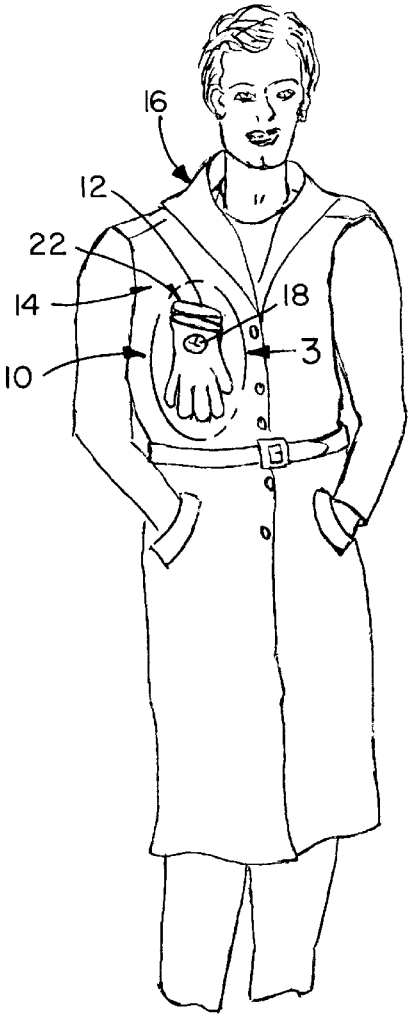
FIG. 3
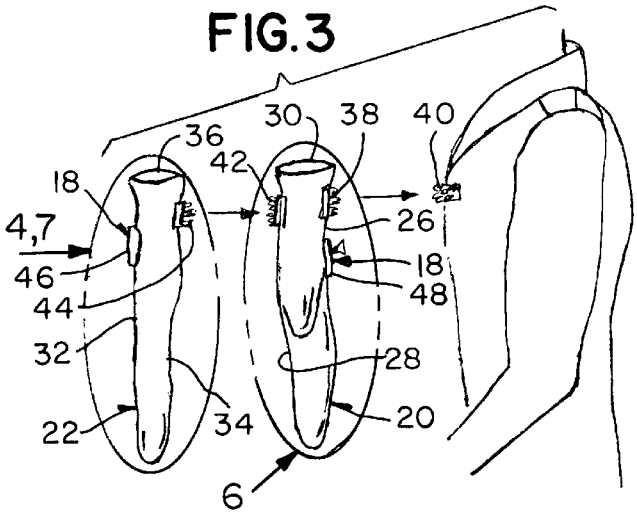
FIG. 2
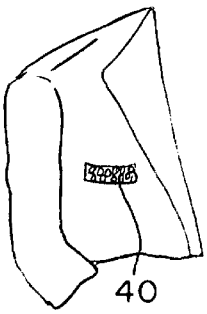
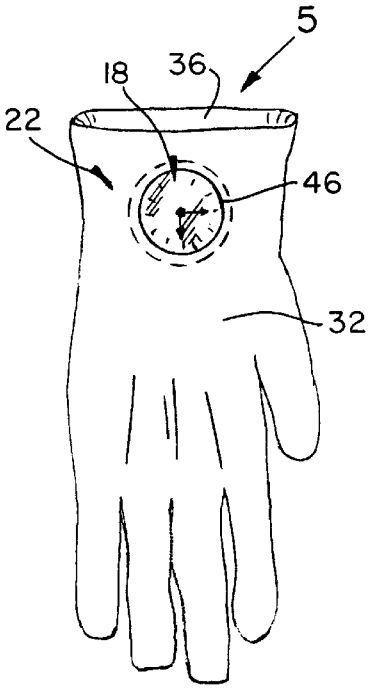
FIG. 4
FIG. 5
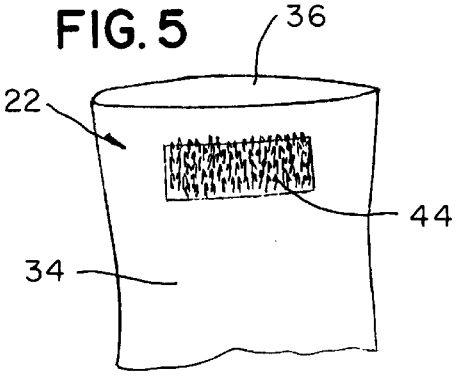

COMBINATION PAIR OF GLOVES WITH HOUSING ACCESSORIES FOR REPLACEABLY ATTACHING TO A GARMENT

BACKGROUND OF THE INVENTION

1. Field of the Invention

The present invention relates to a pair of gloves. More particularly, the present invention relates to a pair of gloves for replaceably attaching to a garment and housing accessories.

2. Description of the Prior Art

Numerous innovations for pairs of gloves have been provided in the prior art that will be described. Even though these innovations may be suitable for the specific individual purposes to which they address, however, they differ from the present invention.

A FIRST EXAMPLE, U.S. Pat. No. Des. 311,271 to Mann teaches the ornamental design for a combined glove and watch.

A SECOND EXAMPLE, U.S. Pat. No. 4,387,838 to Jackson teaches a glove-mounted watch comprising a glove including a wrist portion having a wrist-watch receiving area, a pair of spaced members secured to the outer surface of the wrist portion at opposite sides of the area for receiving the telescopic bracelet pins of a wrist watch, so as to secure a wrist watch in the area, a flap, having a central observation aperture smaller than the face of a wrist watch, secured to the wrist portion to fold over a wrist watch secured in the area, so that the observation aperture may become aligned with the area to enable observation of a watch therein, a first plurality of strips of resilient material is secured to the wrist portion to abut the area, a second plurality of strips of resilient material secured to the inside of the flap to engage the strips of the first plurality when the flap is folded, for closely surrounding a watch in the area, the combined thickness of the strips being less than the thickness of a watch so that when the flap is folded, the rim of the aperture may engage the face of a watch in the area to prevent the passage of undesired matter into the area, the flap being removably secured in folded position over the area.

A THIRD EXAMPLE, U.S. Pat. No. 4,761,835 to Chen teaches at least one information indication article, like a battery-activated watch, a compass, a thermometer, etc. detachably or undetachably disposed in an information indication piece on the wrist and back of a glove portion in a conventional form. One end of the information indication piece is secured with a tightening ring. This ring and a tightening strip provided with Velcro fastener arrangements secure the glove on the user's wrist and dispose the information indication piece in a preferred observation orientation.

A FOURTH EXAMPLE, U.S. Pat. No. 4,862,521 to Mann teaches a watch supporting, protecting and insulating device, wherein, a glove has a pocket, which retains and protects a timepiece, permits viewing of the timepiece, and facilitates storage of other articles in the pocket.

A FIFTH EXAMPLE, U.S. Pat. No. 5,003,637 to Lonon teaches gloves, to the external back surfaces of which a utility attachment, such as a container for cigarettes, driver's license, credit cards, pens, pencils, comb, mirror, watch, radio, first aid equipment, or the like, or a decorative figure or symbol, may be removably attached.

It is apparent that numerous innovations for pairs of gloves have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a pair of gloves for replaceably attaching to a garment and housing accessories that avoids the disadvantages of the prior art.

ANOTHER OBJECT of the present invention is to provide a pair of gloves for replaceably attaching to a garment and housing accessories that is simple and inexpensive to manufacture.

STILL ANOTHER OBJECT of the present invention is to provide a pair of gloves for replaceably attaching to a garment and housing accessories that is simple to use.

BRIEFLY STATED, YET ANOTHER OBJECT of the present invention is to provide a pair of gloves for replaceably attaching to a garment. The pair of gloves include a first glove for covering one hand of a user, a second glove for covering the other hand of the user, and accessories disposed on at least one of the first glove and the second glove. The first glove includes a strip of hook portion of hook and loop fasteners which selectively mates with either a strip of mating loop portions of the hook and loop fasteners positioned on the garment or directly with the garment itself when it is of a loop type material, and a strip of loop portions of hook and loop fasteners. The second glove includes a strip of hook portions of hook and loop fasteners which selectively mates with either the strip of loop portions of hook and loop fasteners of the first glove, another strip a mating loop portions of the hook and loop fasteners for positioning on the garment, or directly with the garment itself when it is of a loop type material. The accessories include a watch sewn into the second glove and which so orientated on the second glove that its is readable when the second glove is attached to the garment, by merely pivoting the second glove slightly upwardly towards the face of the user as the user looks down, and a zippered change pouch sewn into the first glove which allows the zippered change pouch to be hid from view both when worn and when attached to the garment.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows:

FIG. 1 is a diagrammatic perspective view of the present invention replaceably attached to each other and to one side of a breast portion of a garment;

FIG. 2 is an enlarged diagrammatic perspective view taken generally in the direction of hidden arrow 2 in FIG. 4 of the means associated with the one side of the breast portion of the garment for replaceably attaching one glove of the present invention thereto;

FIG. 3 is an enlarged exploded diagrammatic side elevational view of the area generally enclosed by the dotted ellipse identified by, and taken generally in the direction of, arrow 3 in FIG. 1 of the means for attaching the one glove of the present invention to the one side of the breast portion of the garment and means for attaching the other glove of the present invention to the one glove of the present invention;

FIG. 4 is an enlarged diagrammatic front elevational view of the area generally enclosed by the dotted ellipse identified by, and taken generally in the direction of, arrow 4 in FIG. 3 of a watch of the present invention disposed on the other glove of the present invention;

FIG. 5 is a diagrammatic rear elevational view taken generally in the direction of arrow 5 in FIG. 4 of the means associated with the other glove of the present invention for replaceably attaching the other glove of the present invention to the one glove of the present invention;

LIST OF REFERENCE NUMERALS UTILIZED IN THE DRAWING

Figure 8:
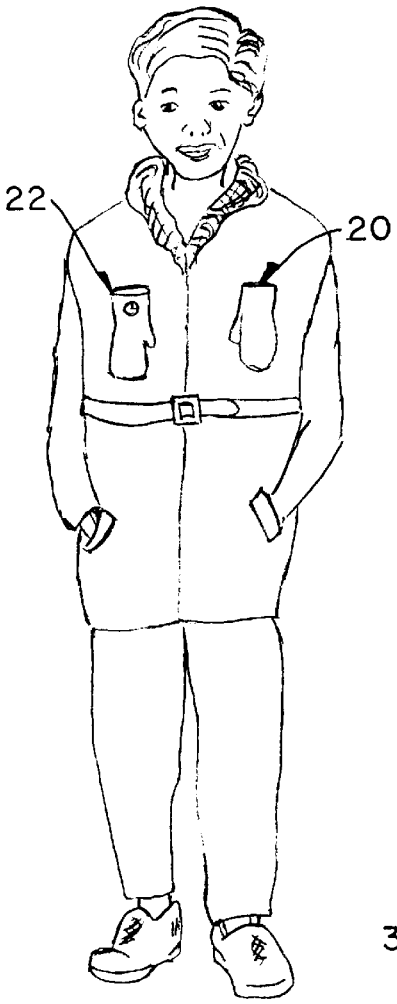
FIG. 8 is a diagrammatic perspective view of the one glove of the present invention and the other glove of the present invention replaceably attached to opposite sides of the breast portion of the garment.

10 pair of gloves for replaceably attaching to a garment and housing accessories of the present invention

12 at least one side of breast portion 14 of garment 16

14 breast portion of garment 16

16 garment

18 accessories

20 first glove for covering one hand of user

22 second glove for covering other hand of user

26 front portion of first glove 20 for covering front of one hand of user

28 back portion of first glove 20 for covering back of one hand of user

30 wrist portion of first glove 20 for encircling wrist of one hand of user

32 front portion of second glove 22 for covering front of other hand of user

34 back portion of second glove 22 for covering back of other hand of user

36 wrist portion of second glove 22 for encircling wrist of other hand of user

38 strip of hook portions of hook and loop fasteners of first glove 20

40 strip of mating loop portions of hook and loop fasteners for positioning on one side of at least one side 12 of breast portion 14 of garment 16

42 strip of loop portions of hook and loop fasteners of first glove 20

44 strip of hook portions of hook and loop fasteners of second glove 22

46 watch of accessories 18

48 zippered change pouch of accessories 18

50 transparent pouch of accessories 18

52 digital watch in transparent pouch 50 of accessories 18

54 beeper in transparent pouch 50 of accessories 18

56 calculator in transparent pouch 50 of accessories 18

58 cellular phone in transparent pouch 50 of accessories 18

60 game chip in transparent pouch 50 of accessories 18

DETAILED DESCRIPTION OF THE PREFERRED EMBODIMENT

Referring now to the figures, in which line numerals indicate like parts, and particularly to FIG. 1, the pair of gloves for replaceably attaching to a garment and housing accessories of the present invention is shown generally at 10 for replaceably attaching to at least one side 12 of a breast portion 14 of a garment 16 and housing accessories 18.

Figure 6:
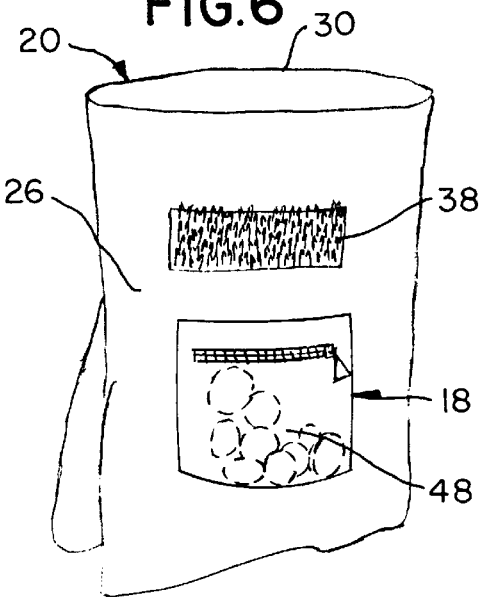
FIG. 6 is an enlarged diagrammatic rear elevational view of the area generally enclosed by the dotted ellipse identified by, and taken generally in the direction of, arrow 6 in FIG. 3 of a zippered change pouch of the present invention and the means associated with and for replaceably attaching the one glove of the present invention to the side of the breast portion of the garment.
Figure 7:
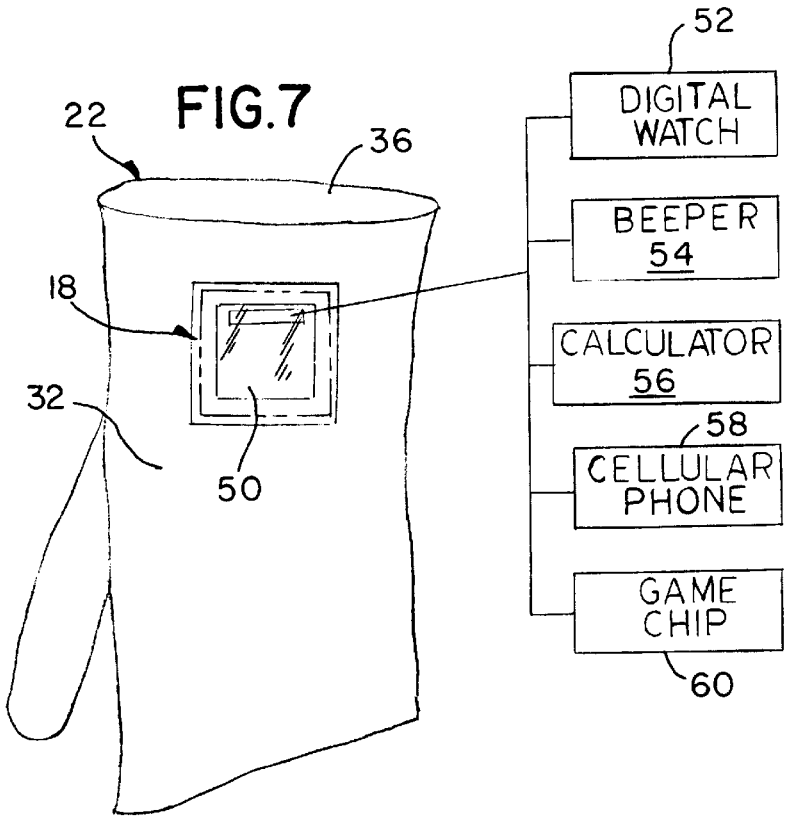
FIG. 7 is an enlarged diagrammatic rear elevational view of the area generally enclosed by the dotted ellipse identified by, and taken generally in the direction of, arrow 7 in FIG. 3 of a pouch of the present invention for accommodating at least one of a digital watch, a beeper, a calculator, a cellular phone, and a game chip.

The configuration of the pair of gloves for replaceably attaching to a garment and housing accessories 10 can best be seen in FIGS. 2–8, and as such will be discussed with reference thereto.

The pair of gloves for replaceably attaching to a garment and housing accessories 10 comprises a first glove 20 for covering one hand of a user, a second glove 22 for covering the other hand of the user, and the accessories 18 are disposed on at least one of the first glove 20 and the second glove 22.

The first glove 20 has a front portion 26 for covering the front of the one hand of the user, a back portion 28 for covering the back of the one hand of the user, and a wrist portion 30 for encircling the wrist of the one hand of the user.

The second glove 22 has a front portion 32 for covering the front of the other hand of the user, a back portion 34 for covering the back of the other hand of the user, and a wrist portion 36 for encircling the wrist of the other hand of the user.

The first glove 20 further comprises a strip of hook portions 38 of hook and loop fasteners disposed on the front side 26 thereof, in close proximity to the wrist portion 30 thereof, and selectively mates with one of a strip of mating loop portions 40 of the hook and loop fasteners for positioning on one side of the at least one side 12 of the breast portion 14 of the garment 16 and directly with the one side of the at least one side 12 of the breast portion 14 of the garment 16 itself when it is of a loop type material, which allows the first glove 20 to be detachably attached to the one side of the at least one side 12 of the breast portion 14 of the garment 16 making its carrying hands free.

The first glove 20 further comprises a strip of loop portions 42 of hook and loop fasteners disposed on the back side 28 thereof, in close proximity to the wrist portion 30 thereof.

The second glove 22 further comprises a strip of hook portions 44 of hook and loop fasteners disposed on the back side 34 thereof, in close proximity to the wrist portion 36 thereof, and selectively mates with one of the strip of loop portions 42 of hook and loop fasteners of the first glove 20, another strip a mating loop portions 40 of the hook and loop fasteners for positioning on the other side of the at least one side 12 of the breast portion 14 of the garment 16, and directly with the one side of the at least one side 12 of the breast portion 14 of the garment 16 itself when it is of a loop type material, which allows the second glove 22 to be detachably attached to one of the other side of the at least one side 12 of the breast portion 14 of the garment 16 and the first glove 20, making its carrying hands free.

The accessories 18 comprise a watch 46 sewn into the front portion 32 of the second glove 22, in close proximity to the wrist portion 36 thereof, with the watch 46 of the accessories 18 being so orientated on the second glove 22 that its is readable when the second glove 22 is attached to the garment 16, by merely pivoting the second glove 22 slightly upwardly towards the face of the user as the user looks down.

The accessories 18 further comprise a zippered change pouch 48 sewn into the front portion 26 of the first glove 22, in close proximity to the strip of hook portions 38 of hook and loop fasteners thereof, which allows the zippered change pouch 48 of the accessories 18 to be hid from view when worn and when attached to the garment 16.

The watch 46 of the accessories 18 can be replaced by a transparent pouch 50 that is for replaceably holding at least one of a digital watch 52, a beeper 54, a calculator 56, a cellular phone 58, and a game chip 60.

It will be understood that each of the elements described above, or two or more together, may also find a useful application in other types of constructions differing from the types described above.

While the invention has been illustrated and described as embodied in a pair of gloves for replaceably attaching to a garment and housing accessories, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A pair of gloves for replaceably attaching to a garment, wherein the garment has a breast portion having a loop type material with at least one side, said pair of gloves comprising:

a) a first glove for covering one hand of a user, wherein said first glove has:

i) a front portion for covering the front of the one hand of the user;

ii) a back portion for covering the back of the one hand of the user; and iii) a wrist portion for encircling the wrist of the one hand of the user;

b) a second glove for covering the other hand of the user; and c) accessories disposed on at least one of said first glove and said second glove, wherein said first glove further comprises a strip of loop portions of hook and loop fasteners disposed on said back side thereof, in close proximity to said wrist portion thereof.

2. The pair of gloves as defined in claim 1, wherein said second glove further comprises a strip of hook portions of hook and loop fasteners disposed on said back side thereof, in close proximity to said wrist portion thereof, and selectively mates with said strip of loop portions of hook and loop fasteners of said first glove, which allows said second glove to be detachably attached to said first glove, making its carrying hands free.

3. A pair of gloves for replaceably attaching to a garment, wherein the garment has a breast portion having a loop type material with at least one side, said pair of gloves comprising:

a) a first glove for covering one hand of a user, wherein said first glove has:

i) a front portion for covering the front of the one hand of the user;

ii) a back portion for covering the back of the one hand of the user; and iii) a wrist portion for encircling the wrist of the one hand of the user;

b) a second glove for covering the other hand of the user; and c) accessories disposed on at least one of said first glove and said second glove, wherein said first glove further comprises a strip of hook portions of hook and loop fasteners disposed on said front side thereof, in close proximity to said wrist portion thereof, and selectively mates with a strip of mating loop portions of said hook and loop fasteners for positioning on one side of the at least one side of the breast portion of the garment, which allows said first glove to be detachably attached to the one side of the at least one side of the breast portion of the garment, making its carrying hands free, wherein said second glove further comprises a strip of hook portions of hook and loop fasteners disposed on said back side thereof, in close proximity to said wrist portion thereof, and selectively mates with another strip a mating loop portions of said hook and loop fasteners for positioning on the other side of the at least one side of the breast portion of the garment, which allows said second glove to be detachably attached to the other side of the at least one side of the breast portion the garment, making its carrying hands free.

4. A pair of gloves for replaceably attaching to a garment, wherein the garment has a breast portion having a loop type material with at least one side, said pair of gloves comprising:

a) a first glove for covering one hand of a user, wherein said first glove has:

i) a front portion for covering the front of the one hand of the user;

ii) a back portion for covering the back of the one hand of the user; and iii) a wrist portion for encircling the wrist of the one hand of the user;

b) a second glove for covering the other hand of the user; and c) accessories disposed on at least one of said first glove and said second glove, wherein said first glove further comprises a strip of hook portions of hook and loop fasteners disposed on said front side thereof, in close proximity to said wrist portion thereof, and selectively mates with a strip of mating loop portions of said hook and loop fasteners for positioning on one side of the at least one side of the breast portion of the garment, which allows said first glove to be detachably attached to the one side of the at least one side of the breast portion of the garment, making its carrying hands free, wherein said second glove further comprises a strip of hook portions of hook and loop fasteners disposed on said back side thereof, in close proximity to said wrist portion thereof, and for selectively mating directly with the other side of the at least one side of the breast portion of the garment itself when it is of a loop type material, which allows said second glove to be detachably attached to the other side of the at least one side of the breast portion of the garment, making its carrying hands free.

5. A pair of gloves for replaceably attaching to a garment, wherein the garment has a breast portion having a loop type material with at least one side, said pair of gloves comprising:

a) a first glove for covering one hand of a user, wherein said first glove has:

i) a front portion for covering the front of the one hand of the user;

ii) a back portion for covering the back of the one hand of the user; and iii) a wrist portion for encircling the wrist of the one hand of the user;

b) a second glove for covering the other hand of the user; and c) accessories disposed on at least one of said first glove and said second glove, wherein said first glove further comprises a strip of hook portions of hook and loop fasteners disposed on said front side thereof, in close proximity to said wrist portion thereof, and selectively mates with a strip of mating loop portions of said hook and loop fasteners for positioning on one side of the at least one side of the breast portion of the garment, which allows said first glove to be detachably attached to the one side of the at least one side of the breast portion of the garment, making its carrying hands free, wherein said accessories comprise a zippered change pouch sewn into said front portion of said first glove, in close proximity to said strip of hook portions of hook and loop fasteners thereof, which allows said zippered change pouch of said accessories to be hid from view both when worn and when attached to the garment.

6. A pair of gloves for replaceably attaching to a garment, wherein the garment has a breast portion having a loop type material with at least one side, said pair of gloves comprising:

a) a first glove for covering one hand of a user, wherein said first glove has:

i) a front portion for covering the front of the one hand of the user;

ii) a back portion for covering the back of the one hand of the user; and iii) a wrist portion for encircling the wrist of the one hand of the user;

b) a second glove for covering the other hand of the user; and c) accessories disposed on at least one of said first glove and said second glove, wherein said first glove further comprises a strip of hook portions of hook and loop fasteners disposed on said front side thereof, in close proximity to said wrist portion thereof, and selectively mates with a strip of mating loop portions of said hook and loop fasteners for positioning on one side of the at least one side of the breast portion of the garment, which allows said first glove to be detachably attached to the one side of the at least one side of the breast portion of the garment, making its carrying hands free, wherein said accessories comprise a zippered change pouch sewn into said front portion of said first glove, in close proximity to said strip of hook portions of hook and loop fasteners thereof, which allows said zippered change pouch of said accessories to be hid from view both when worn and when attached to the garment.

7. A pair of gloves for replaceably attaching to a garment, wherein the garment has a breast portion having a loop type material with at least one side, said pair of gloves comprising:

a) a first glove for covering one hand of a user, wherein said first glove has:

i) a front portion for covering the front of the one hand of the user;

ii) a back portion for covering the back of the one hand of the user; and iii) a wrist portion for encircling the wrist of the one hand of the user;

b) a second glove for covering the other hand of the user; and c) accessories disposed on at least one of said first glove and said second glove, wherein said first glove further comprises a strip of hook portions of hook and loop fasteners disposed on said front side thereof, in close proximity to said wrist portion thereof, and for selectively mating directly with one side of the at least one side of the breast portion of the garment itself when it is of a loop type material, which allows said first glove to be detachably attached to the one side of the at least one side of the breast portion of the garment, making its carrying hands free, wherein said accessories comprise a zippered change pouch sewn into said front portion of said first glove, in close proximity to said strip of hook portions of hook and loop fasteners thereof, which allows said zippered change pouch of said accessories to be hid from view both when worn and when attached to the garment.

8. A pair of gloves for replaceably attaching to a garment, wherein the garment has a breast portion having a loop type material with at least one side, said pair of gloves comprising:

a) a first glove for covering one hand of a user, wherein said first glove has:

i) a front portion for covering the front of the one hand of the user;

ii) a back portion for covering the back of the one hand of the user; and iii) a wrist portion for encircling the wrist of the one hand of the user;

b) a second glove for covering the other hand of the user, wherein said second glove has:

i) a front portion for covering the front of the other hand of the user;

ii) a back portion for covering the back of the other hand of the user; and iii) a wrist portion for encircling the wrist of the other hand of the user; and c) accessories disposed on at least one of said first glove and said second glove, wherein said accessories comprise a transparent pouch sewn into said front portion of said second glove, in close proximity to said wrist portion thereof, and is for replaceably holding at least one of a digital watch, a beeper, a calculator, a cellular phone, and a game chip.

* * * * *